US007427963B2

(12) United States Patent
Moriya

(10) Patent No.: US 7,427,963 B2
(45) Date of Patent: Sep. 23, 2008

(54) ANTENNA COIL AND ANTENNA DEVICE

(75) Inventor: Hitoshi Moriya, Sendai (JP)

(73) Assignee: Sumida Corporation, Tokyo (JP)

( * ) Notice: Subject to any disclaimer, the term of this patent is extended or adjusted under 35 U.S.C. 154(b) by 226 days.

(21) Appl. No.: 10/575,941

(22) PCT Filed: Oct. 7, 2004

(86) PCT No.: PCT/JP2004/015187

§ 371 (c)(1),
(2), (4) Date: May 15, 2006

(87) PCT Pub. No.: WO2005/038982

PCT Pub. Date: Apr. 28, 2005

(65) Prior Publication Data

US 2007/0075913 A1 Apr. 5, 2007

(30) Foreign Application Priority Data

Oct. 16, 2003 (JP) ..... 2003-355937

(51) Int. Cl.
*H01Q 7/08* (2006.01)

(52) U.S. Cl. ..... 343/788; 343/713

(58) Field of Classification Search ..... 343/788, 343/787, 866, 713, 895
See application file for complete search history.

(56) References Cited

U.S. PATENT DOCUMENTS 4,101,899 A 7/1978 Jones, Jr. et al.
6,052,097 A * 4/2000 Duncan et al. ..... 343/788
2002/0033777 A1 3/2002 Maruyama et al.
2003/0184489 A1 10/2003 Maruyama et al.
2006/0214866 A1 * 9/2006 Araki et al. ..... 343/788
2007/0195001 A1 * 8/2007 Ueda ..... 343/788

FOREIGN PATENT DOCUMENTS

| | | |
|---|---|---|
| DE | 20000874 | 6/2001 |
| DE | 10128406 | 1/2002 |
| EP | 1349236 | 1/2003 |
| GB | 2005921 | 4/1979 |

OTHER PUBLICATIONS

EPO—supplementary European Search report; dated Oct. 16, 2006; 3 pages.

* cited by examiner

*Primary Examiner*—HoangAnh T Le
(74) *Attorney, Agent, or Firm*—Mark Montague; Cowan, Liebowitz & Latman, P.C.

(57) ABSTRACT

An antenna coil includes: a core (3) formed by shaping a magnetic material into a bar-like configuration; a bobbin (1) having a through-hole (12) into which the core (3) is to be inserted; a connection section (15) fixed to the bobbin (1) so as to extend in a length direction of the core (3) from the bobbin (1), with the core (3) inserted into the through-hole (12); a winding (14) which is wound around the bobbin (1) and whose ends are connected to the connection section (15); and a connector terminal (25) which is provided at a certain position in the length direction of the core (3), which fixes the connection section (15) in position, and which determines the position of the winding (14) in the length direction of the core (3).

8 Claims, 5 Drawing Sheets

ANTENNA COIL AND ANTENNA DEVICE

TECHNICAL FIELD

The present invention relates to an antenna coil and an antenna device to be used, for example, to transmit and receive a radio wave.

BACKGROUND ART

Japanese Utility Model Examined Publication No. Sho44-18178 (hereinafter referred to as Patent Document 1) discloses a ferrite antenna. This ferrite antenna has a bar-shaped ferrite core, a coil bobbin into which the ferrite core is inserted, a main coil wound around the coil bobbin, and a small coil provided on each side of the main coil. In this ferrite antenna, the main coil is moved in a length direction of the ferrite core to cause a change in inductance, making it possible to perform tracking adjustment.

However, in the conventional ferrite antenna, the electrical connection between the small coils and the main coil is effected by using windings forming these coils as they are.

Thus, in a case in which the main coil is moved with a view to setting the reactance value of the ferrite antenna to a desired value, when the main coil is released, the main coil is pulled by the windings connecting the small coils and the main coil, resulting in positional deviation of the main coil. If the main coil is fixed in position by resin, a tape or the like while retaining it by hand, etc., the main coil is likely to be shifted during curing of the resin, or the adhesive force of the tape is likely to be reduced, resulting in positional deviation of the main coil. As a result, the completed product is likely to involve variation in reactance value. Further, in the case in which an attempt is made to fix the main coil at a desired position with resin, the next operation cannot be performed until the resin has been dried and cured, resulting in a rather long assembly time.

To suppress such positional deviation of the main coil, it might be possible to increase the length of the windings connecting the small coils and the main coil, attaining a length providing some room with respect to the adjustment range of the main coil. However, when the length of the windings connecting the small coils and the main coil is increased, the wiring may be shaken due to vibration or the like applied to the ferrite antenna, and a fatal problem, such as a breaking of wire, is likely to occur. Further, due to the shaking of the windings connecting the small coils and the main coil, it is rather difficult to stabilize the reactance value.

The present inventor has conducted careful study to solve the above problems before completing the present invention.

An object of the present invention is to obtain an antenna coil and an antenna device which allow easy positional adjustment of the winding sand which is relatively free from positional deviation of the windings after the adjustment.

SUMMARY OF THE INVENTION

An antenna coil according to the present invention includes: a core formed by shaping a magnetic material into a bar-like configuration; a bobbin having a through-hole into which the core is to be inserted; a connection section fixed to the bobbin so as to extend in a length direction of the core from the bobbin, with the core inserted into the through-hole; a winding which is wound around the bobbin and whose ends are connected to the connection section; and a connector terminal which is provided at a certain position in the length direction of the core, which fixes the connection section in position, and which determines a position of the winding in the length direction of the core.

With this construction, the winding is electrically connected to the connector terminal through the intermediation of the connection section. Therefore, it is possible to set the reactance value at a desired value by moving the winding together with the bobbin in the length direction of the core. In particular, even if the coil is released after being moved with the bobbin in the core length direction to be positioned at a desired position, the coil remains at that position together with the bobbin. Further, even when the coil is moved together with the bobbin in the core length direction, no force due to expansion and contraction of the winding, etc. is generated between the coil, which is moved with the bobbin, and the connector terminal. As a result, it is easy to adjust the position of the coil together with the bobbin such that a desired reactance value is obtained.

Further, solely by fixing the connection section and the connector terminal to each other by soldering or the like after adjustment, it is possible to settle the winding at a position providing a desired reactance value. As a result, there is no fear of the winding position being deviated after adjustment, and it is possible to suppress variation in reactance value in the completed product.

Further, since it is possible to fix a position of the winding by fixing the connection section in position by the connector terminal, it is possible, in contrast to the case in which the coil is sealed with an insulating resin or the like together with the bobbin, to begin the next operation without having to wait until the resin is dried (until the adhesive is cured). As a result, it is possible to shorten the assembly time.

In addition to a construction of the invention as described above, in an antenna coil according to the present invention, the connector terminal is provided on a connector main body having another through-hole into which the core is to be inserted.

By adopting this construction, it is also possible to move the connector main body in the core length direction. Therefore, the position of the connector terminal in the antenna coil can be easily changed without changing the basic structure of the antenna coil. As a result, even in a case where antenna coils of a plurality of specifications, for example, antenna coils having the same requisite reactance value and different connector terminal positions, are required, it is possible to provide antenna coils of such specifications by using a single kind of antenna coil.

In addition to the constructions of the inventions as described above, in an antenna coil according to the present invention, the connection section is formed of a rigid material; a second through-hole is formed in the connector main body so as to extend along the other through-hole; and the connection section is inserted into the second through-hole.

By adopting this construction, the connection section is formed of a rigid material, and both ends thereof are retained by the bobbin, the core, and the connector main body. Therefore, as compared with the case in which the bobbin and the connector are connected by a winding, vibration is less likely to occur even if vibration is applied to the antenna coil, so a fatal problem, such as an electrical breaking of wire, is not easily caused.

Further, there is no fear of the connection section slacking between the bobbin and the connector. Therefore, in contrast to the conventional construction in which the wiring slacks between the winding and the connector, there is no fear of the reactance value fluctuating due to shaking of the slack wiring caused by vibration, etc.

In addition to the constructions of the inventions as described above, in an antenna coil according to the present invention, a capacitor is provided on the connector main body; and the connector terminal is connected to the capacitor.

By adopting this construction, a resonance circuit is formed by the coil and the capacitor in the antenna coil. In particular, the coil and the capacitor are integrated, so it is easy to adjust a characteristic, such as the resonance frequency of this resonance circuit, to a predetermined characteristic. Further, in contrast to the case in which the coil and the capacitor are provided separately, the resonance circuit is relatively free from the influence of the length of the wiring between the coil and the capacitor, so it is possible to suppress variation in characteristics of the resonance circuit.

In addition to the constructions of the inventions as described above, in an antenna coil according to the present invention, the connection section has two conductive rigid members; one end of the winding is connected to one rigid member of the connection section; another end of the winding is connected to another rigid member of the connection section; the connector terminal has two conductive joint portions; one joint portion of the connector terminal fixes in position the rigid member of the connection section to which the one end of the winding is connected; and another joint portion of the connector terminal fixes in position the rigid member of the connection section to which the another end of the winding is connected.

By adopting this construction, the winding can be connected to a radio circuit through the connector terminal, and there is no need to provide a lead or the like which leads from the winding and the bobbin to the exterior of the antenna coil and which is subject to a breaking of wire, and there is little possibility of a breaking of wire.

An antenna device according to the present invention includes: an antenna coil according to the inventions described above; a holder having an accommodating portion formed by a holder main body and a side surface portion provided upright on the holder main body, with the accommodating portion accommodating the antenna coil; and a cover for hermetically sealing the accommodating portion.

By adopting this construction, it is possible to cover the entire antenna coil with the holder and the cover. As a result, it is possible to maintain a stable electrical characteristic for a long period of time.

In addition to the constructions of the inventions as described above, in an antenna device according to the present invention, the connector terminal of the antenna coil is provided on a connector main body having another through-hole into which the core is to be inserted; and the side surface portion and the connector main body of the antenna coil respectively have engagement portions engaged with each other and determining a position of the connector main body in a length direction of the core.

By adopting this construction, the connector main body of the antenna coil is engaged with the side surface portion of the holder by these engagement portions. Therefore, it is possible to fix the connector main body of the antenna coil and the bobbin connected thereto through the connection section (and, by extension, the winding) at desired positions inside the accommodating portion.

In addition to the constructions of the inventions as described above, an antenna device according to the present invention, further includes two cushion members having through-holes into which the core of the antenna coil is inserted and higher than a depth of the accommodating portion. In the antenna device, an engagement member provided on the cover is inserted into a through-hole formed in the holder main body, whereby the cover hermetically seals the accommodating portion.

By adopting this construction, in the state in which the accommodating portion is hermetically sealed by the cover, the two cushion members are compressed between the cover and the holder main body. The core is held by the pressurizing force of the cushion members, so the core is fixed in position inside the accommodating portion. Therefore, it is possible to fix the connector main body, the bobbin, the winding, and the core in position inside the accommodating portion without having to use fixing members, such as screws, adhesive, or the like. As a result, it is possible to attain, through adjustment, a desired positional relationship between the core and the bobbin, and maintain the same.

DETAILED DESCRIPTION OF THE INVENTION

In the following, an antenna coil and an antenna device according to an embodiment of the present invention will be described with reference to the drawings. In the following description, the antenna coil is regarded as constituting a part of the antenna device.

Embodiment

Figure 1:
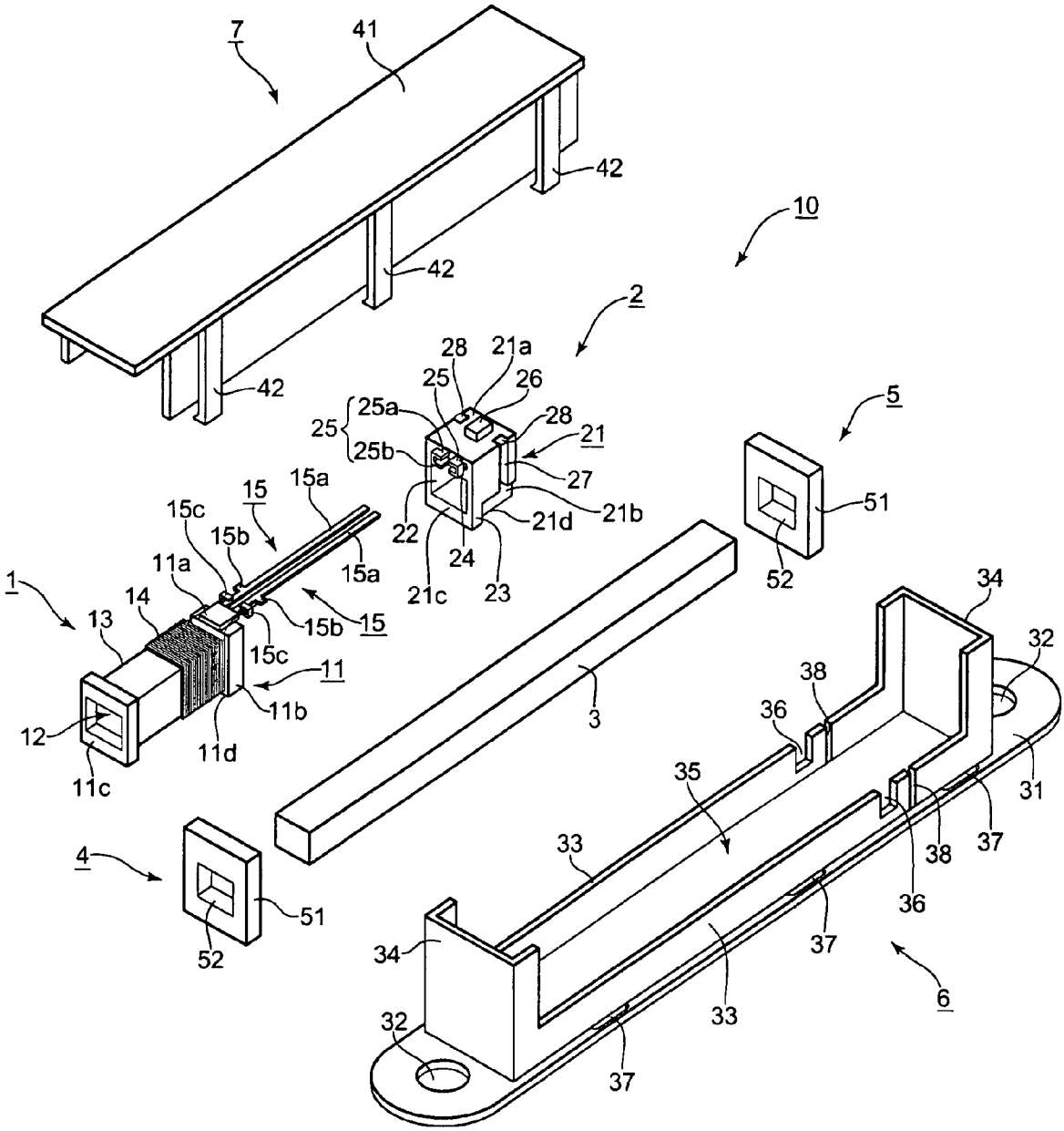
FIG. 1 is an exploded perspective view of an antenna device according to an embodiment of the present invention.

FIG. 1 is an exploded perspective view of an antenna device 10 according to an embodiment of the present invention. The antenna device 10 has a bobbin 1, a connector 2, a core 3, two cushion members 4 and 5, a holder 6, and a cover 7.

The bobbin 1 has a bobbin main body 11. The bobbin main body 11 is formed of an insulating material such as plastic, and has a substantially rectangular parallelepiped-shaped outer configuration. Flanges are formed at the ends of a pair of opposing surfaces of the bobbin main body 11, and a winding is wound around the remaining four surfaces of the bobbin main body 11. Regarding the outer configuration of the bobbin main body 11, it may also be formed as a cube whose six surfaces are of the same size, or as a cylinder. In the following, in the attitude as shown in FIG. 1, the surface on the upper side as seen in the figure will be referred to as the upper surface 11*a* of the bobbin main body 11, the side surfaces with a larger lateral width as seen in the figure will be referred to as the longer side surfaces 11*b* of the bobbin main body 11, the side surfaces with a smaller lateral width as seen in the figure will be referred to as the shorter side surfaces 11*c* of, the bobbin main body 11, and the surface opposed to the upper surface 11*a* of the bobbin main body 11 will be referred to as the lower surface lid of the bobbin main body 11.

The bobbin main body 11 has a through-hole 12 extending in the longitudinal direction of its rectangular parallelepiped configuration. As a result, openings are formed in the two shorter side surfaces 11*c* of the bobbin main body 11. The through-hole 12 has a rectangular sectional configuration. The sectional configuration of the through-hole 12 may also be square or circular. The sectional configuration of the through-hole 12 is preferably similar to the outer configuration of the bobbin main body 11. In this case, the bobbin main body 11 is formed in a substantially uniform, thin wall thickness.

Further, the bobbin main body 11 has a recess 13 formed by the side surfaces and the flanges. The recess 13 is formed over the entire periphery formed by the upper surface 11*a*, the two longer side surfaces 11*b*, and the lower surface 11*d* of the bobbin main body 11. A winding 14 formed of a conductive material such as copper wire, is wound around the recess 13. As a result, a coil is formed. The bobbin main body 11 has flanges at both longitudinal ends thereof, so there is no fear in that the winding 14 may slip off the bobbin main body 11. Further, the bobbin main body 11 has flanges at both longitudinal ends thereof, so the winding of the winding 14 can be started from one of the those two ends, thus the operation of winding the winding 14 around the bobbin main body 11 can be made easier.

Two long terminals 15 as connection sections are fixed to one longitudinal end of the bobbin main body 11. The long terminals 15 are formed as rigid members formed of a metal such as steel or aluminum, which is harder than the winding 14, and each of the long terminals 15 has a long terminal main body 15*a* and two protrusions 15*b*, 15*c*. The long terminal main body 15*a* is formed in a bar-like configuration. The two protrusions 15*b*, 15 care provided at positions nearer to one end of the long terminal main body 15*a*, and protrude in a direction perpendicular to the length direction of the long terminal main body 15*a*. One end of the long terminal main body 15*a* of each long terminal 15 is fixed to a portion on one of the surfaces 11*c* of the bobbin main body 11 near the surface 11*a*. The fixation of each long terminal 15 is effected by inserting one end of the long terminal main body 15*a* into a fit-engagement hole formed in the bobbin main body 11. The two long terminals 15 are fixed to the bobbin main body 11 such that their long terminal main bodies 15*a* are substantially parallel to each other and extend in the longitudinal direction of the through-hole 12 of the bobbin main body 11.

Each end of the winding 14 is connected to the protrusions 15*b* of the two long terminals 15 nearer to the other ends (distal ends) by soldering or the like. The protrusion 15*c* nearer to one end (fixed end) of each long terminal 15 is bent, and each end of the winding 14 is held by the bent protrusions 15*c*. As a result, even if, due to vibration or the like, there is exerted to the winding 14 such a force as would move the winding 14 in the longitudinal direction of the bobbin main body 11, that force is not easily allowed to act on the connecting portions.

The connector 2 has a connector main body 21. The connector main body 21 is formed of an insulating material such as an insulating plastic, and is formed in a substantially rectangular parallelepiped-shaped configuration. The outer configuration of the connector main body 21 may also be substantially cylindrical. In the following, in the attitude as shown in FIG. 1, the surface on the upper side as seen in the figure will be referred to as the upper surface 21*a* of the connector main body 21, a pair of opposing side surfaces as seen in the figure will be referred to as the first side surfaces 21*b* of the connector main body 21, another pair of opposing side surfaces will be referred to as the second side surfaces 21*c* of the connector main body 21, and the surface opposed to the upper surface 21*a* of the connector main body 21 will be referred to as the lower surface 21*d* of the connector main body 21.

The connector main body 21 has a through-hole 22 formed therein as another through-hole. As a result, openings are formed in the two second side surfaces 21*c* of the connector main body 21. The through-hole 22 has a rectangular sectional configuration. The sectional configuration of the through-hole 22 may also be square or circular. It is desirable, however, for the through-hole 22 of the connector main body 21 to be of the same sectional configuration as the through-hole 12 of the bobbin main body 11.

Each of the two first side surfaces 21*b* of the connector main body 21 has rib portions 23 as engagement portions. The rib portions 23 are formed at positions on the first side surfaces 21*b* near the lower surface 21*d* so as to be perpendicular to the lower surface 21*d*. That is, the portions of the first side surfaces 21*b* near the lower surface 21*d* are cut away, leaving the rib portions 23.

The connector main body 21 has a second through-hole 24 parallel to the through-hole 22. As a result, the two second side surfaces 21*c* of the connector main body 21 has openings at positions nearer to the upper surface 21*a* than the through-hole 22.

The connector 2 has two connector terminals 25. The connector terminals 25 are formed of a conductive material, and a part thereof protrudes from between the second through-hole 24 of one of the two second side surfaces 21*c* and the upper surface 2l*a*. At the forward ends of the protrusions 25*a*of the connector terminals 25, there are formed bent portions 25*b* protruding in a direction perpendicular to the protruding direction. The bent portions 25*b* are further bent toward the lower side of the protrusions 25*a*. Gaps are formed between the bent portions 25*b*, which are bent, and the protrusions 25*a*.

A capacitor 26 is arranged on the upper surface 21*a* of the connector main body 21. The capacitor 26 is soldered to one of the two connector terminals 25. A resonance circuit is formed by the capacitor 26 and the winding 14.

The two surfaces 21*b* has grooves 27 formed to be perpendicular to the surfaces 21*a*, and terminals 28 are provided at the surface 21*a* side ends of the grooves 27. The terminals 28 are electrically connected to the resonance circuit formed by the capacitor 26 and the winding 14. Connected to the terminals 28 are an external radio circuit, wiring, etc.

The core 3 is formed of a magnetic material such as nickel zinc ferrite or manganese zinc ferrite, and has a bar-like configuration. The core 3 has a rectangular section substantially of the same size as the through-hole 12 of the bobbin 1 and the through-hole 22 of the connector 2 or slightly smaller than the through-holes 12, 22. That is, the sectional configuration of the core 3 is such that the through-holes 12, 22 are slidable when the core 3 is inserted into the through-holes 12, 22. The sectional configuration of the core 3 may be square or circular.

The holder 6 has a holder main body 31. The holder main body 31 is formed of an insulating material such as insulating plastic, and is formed as a flat plate longer than the core 3. A through-hole 32 is formed at either end of the holder main body 31.

Provided upright on the holder main body 31 are two longer side surface portions 33 as side surface portions, and two shorter side surface portions 34 as side surface portions. The two longer side surface portions 33 and the two shorter side surface portions 34 form an oblong box with no lid together with the holder main body 31. In the following, this oblong box will be referred to as an accommodating portion 35. The inside of the accommodating portion 35 is longer than the core 3, and is formed in a width which is the same as or somewhat longer than the width of the shorter side surfaces

11*c* of the bobbin main body 11 and the second side surfaces 21*c* of the connector main body 21.

In each of the two longer side surface portions 33, there is formed a cutout portion 36 as an engagement portion. Further, the two longer side surface portions 33 are provided upright at positions somewhat on the inner side of the outer peripheral edge of the holder main body 31. Between each of the longer side surface portion 33 and the outer peripheral edge of the holder main body 31, there are formed three through-holes 37.

Further, cut out portions 38 are formed in the longer side surface portions 33, and the holder main body 31 has through-holes 39 (see FIG. 4) formed therein extending from the cutout portions 38 of the longer side surface portions 33.

The cover 7 has a cover main body 41. The cover main body 41 is formed of an insulating material such as insulating plastic, and is formed as an elongated flat plate. The longer sides of the cover main body 41 have the same length as the longer side surface portions 33 of the holder 6, and the shorter sides of the cover main body 41 have the same length as the shorter side surface portions 34 of the holder 6. Further, the cover main body 41 has six engagement members 42 provided upright. The six engagement members 42 are arranged along the longer sides of the cover main body 41, three on each side.

The cushion members 4, 5 have cushion main bodies 51. The cushion main bodies 51 are formed of a flexible rubber material, and are formed as vertically elongated cubes. The height of the cushion main bodies 51 is somewhat larger than the depth of the accommodating portion 35. Further, the cushion main bodies 51 have through-holes 52. The through-holes 52 of the cushion are formed to be of the same size as or slightly smaller than the contour of the core 3.

Next, the assembly of the antenna device 10, constructed as described above, and the adjustment of the resonance frequency of the antenna device 10 will be described.

Figure 2:
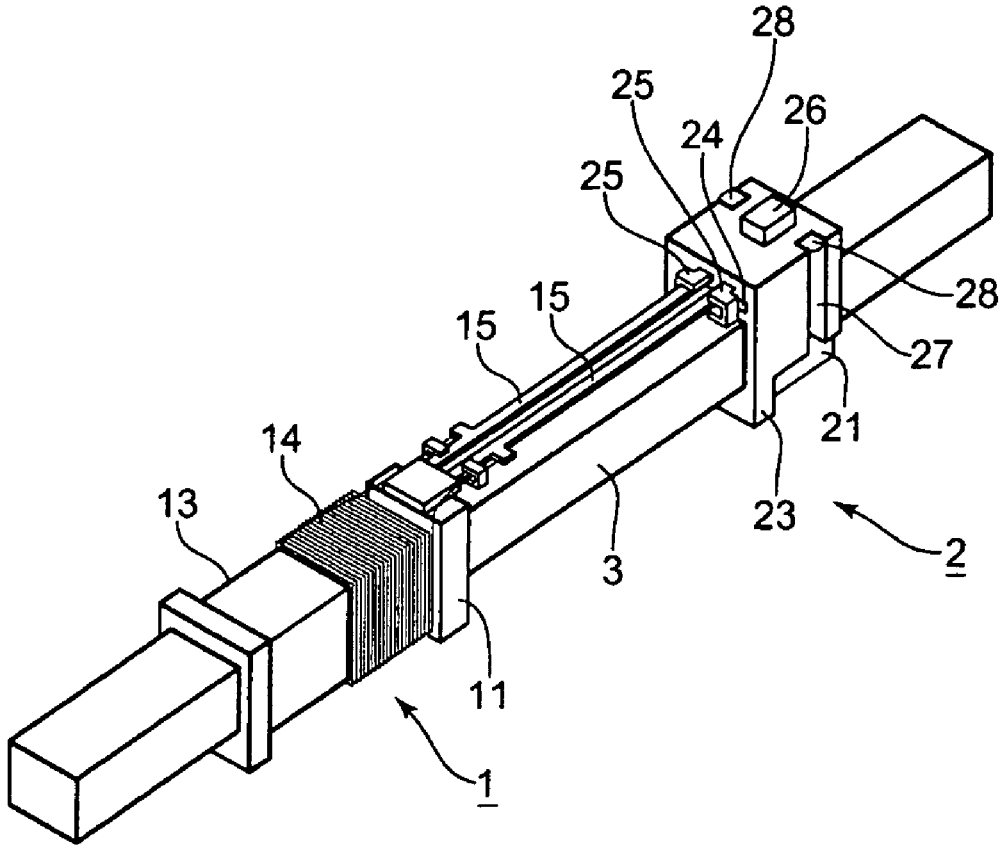
FIG. 2 is a perspective view for illustrating a first step of assembling the antenna device shown in FIG. 1.

FIG. 2 is a perspective view for illustrating a first assembly step for the antenna device 10 shown in FIG. 1. First, the core 3 is inserted into the through-hole 12 of the bobbin 1, to which the two long terminals 15 are fixed, and into the through-hole 22 of the connector 2. Further, the two long terminals 15 of the bobbin 1 are inserted into the gaps between the protrusions 25*a* and the bent portions 25*b* of the connector terminals 25, and into the second through-hole 24 of the connector 2.

Figure 3:
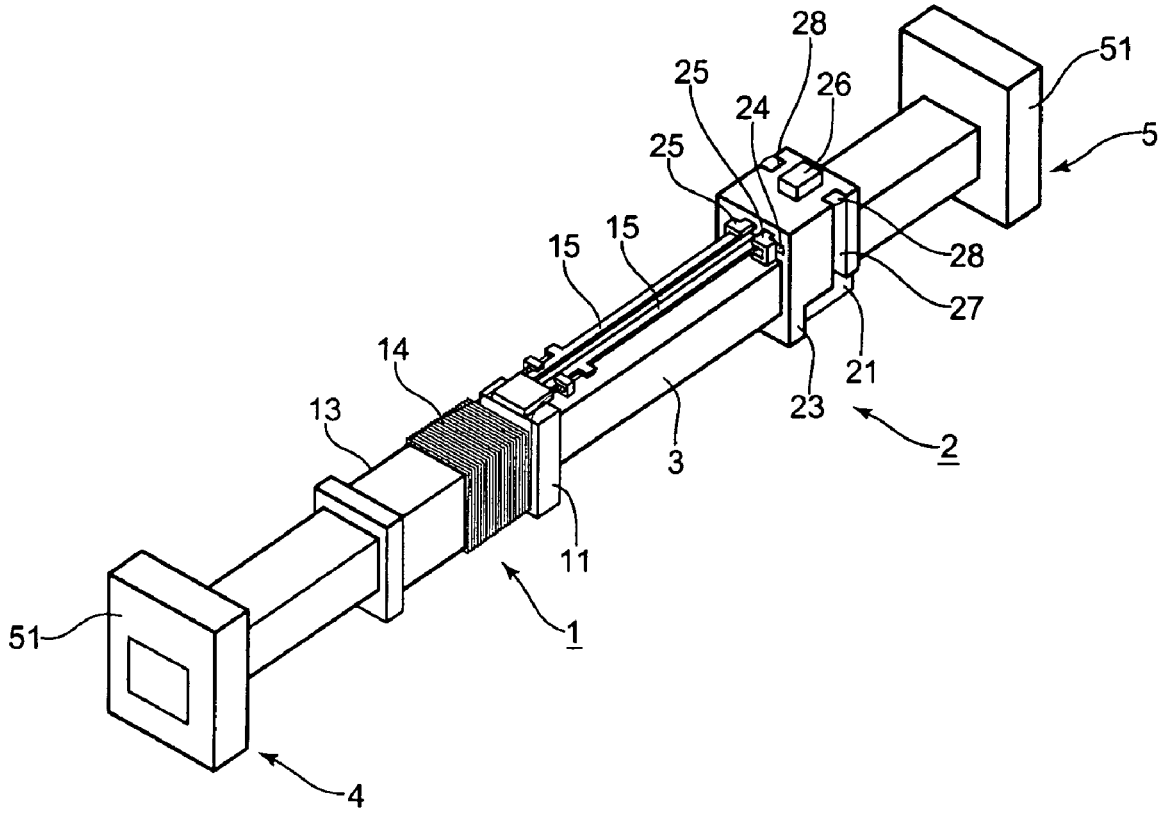
FIG. 3 is a perspective view for illustrating a second step of assembling the antenna device shown in FIG. 1.

FIG. 3 is a perspective view for illustrating a second assembly step for the antenna device 10 shown in FIG. 1. After that, the end portions of the core 3, inserted into the bobbin and the connector 2, are respectively inserted into the through-holes 52 of the cushion members 4, 5.

Figure 4:
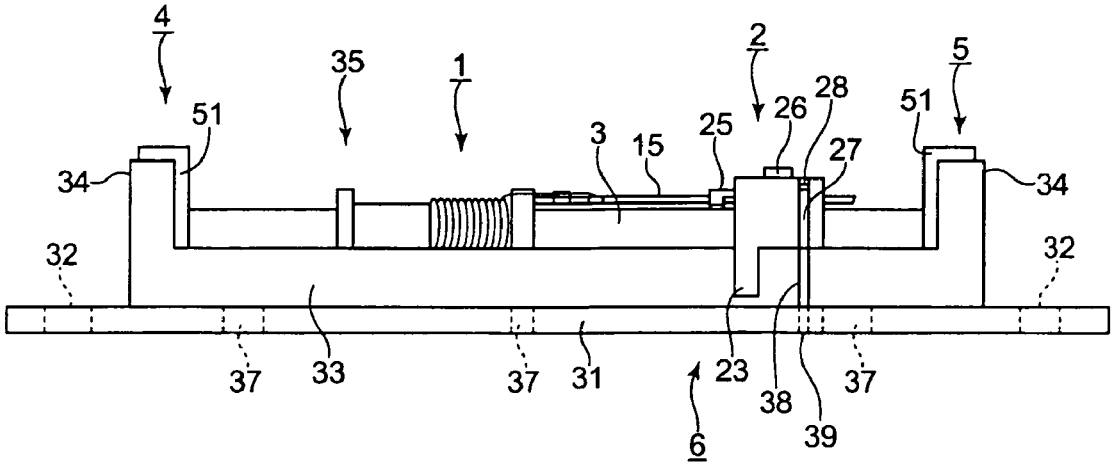
FIG. 4 is a side view for illustrating a third step of assembling the antenna device shown in FIG. 1.

FIG. 4 is a side view for illustrating a third assembly step for the antenna device 10 shown in FIG. 1. The core 3, to which the bobbin 1, the connector 2, and the two cushion members 4, 5 are mounted, is inserted into the accommodating portion 35 of the holder 6. At this time, the two cushion members 4, 5 are arranged adjacent to the two shorter side surface portions 34. The two rib portions 23 of the connector 2 are respectively inserted into the cutout portions 36 of the holder 6. The grooves 27 of the connector 2 are arranged so as to be continuous with the cutout portions 38. As a result, the connector 2 is fixed in position inside the accommodating portion 35, and there is no fear in that the connector 2 may move even if the holder 6 is moved within the accommodating portion 35.

In the assembly state of FIG. 4, the resonance frequency of the antenna device 1 is adjusted by moving the bobbin 1 in the length direction of the core 3. At this point in time, the bobbin 1 is not fixed in position but is slidable in the length direction of the core 3. To be more specific, an AC voltage of a predetermined resonance frequency is applied to the portion between the capacitor 26 and the other connector terminal 25 through the terminal 28, and the impedance is measured while varying the position of the bobbin 1, that is, the position of the winding 14, in the length direction of the core 3, then the bobbin 1, that is, the winding 14 is arranged at a position where the impedance is at an extreme value. As a result, the reactance value due to the winding 14 and the core 3 attains a desired value.

After the positional adjustment of the bobbin 1 in the length direction of the core 3 has been completed, the long terminals 15 and the connector terminals 25 are fixed to each other in that state. In this process, for example, a force is applied to the two connector terminals 25 of the connector 2 from above (that is, from the side opposite to the core 3), and the bent portions 25*b* are brought into contact with the core 3 to press bond the long terminals 15 and the connector terminal 25 to each other.

After that, the two long terminals 15 and the two connector terminals 25 are soldered to each other. As a result, synergistically with the fact that the bent portions 25*b* are engaged in the lower surfaces of the long terminals 15, the electrical connection between the long terminals 15 and the connector terminals 25 is made firm. It is also possible to apply an insulating adhesive to the periphery of the bobbin 1 and the connector 2 to make it hard for them to move.

Finally, the cover 7 is put on the accommodating portion 35 of the holder 6. At this time, the six engagement members 42 of the cover 7 are respectively inserted into the thorough-holes 37 of the holder 6. The cover 7 is pushed in until the distal ends of the engagement members 42 hook into the holder 6, thereby sealing the interior of the accommodating portion 35 by the cover main body 41. In the state in which the accommodating portion 35 is sealed, the two cushion members 4, 5 are compressed to some degree by the cover main body 41, and the end portions of the core 3 are held by the pressurizing force of the cushion members 4, 5. As a result, it becomes hard for the core 3 to move within the accommodating portion 35, making it possible to maintain the previously adjusted positional relationship between the core 3 and the bobbin 1.

Figure 5:
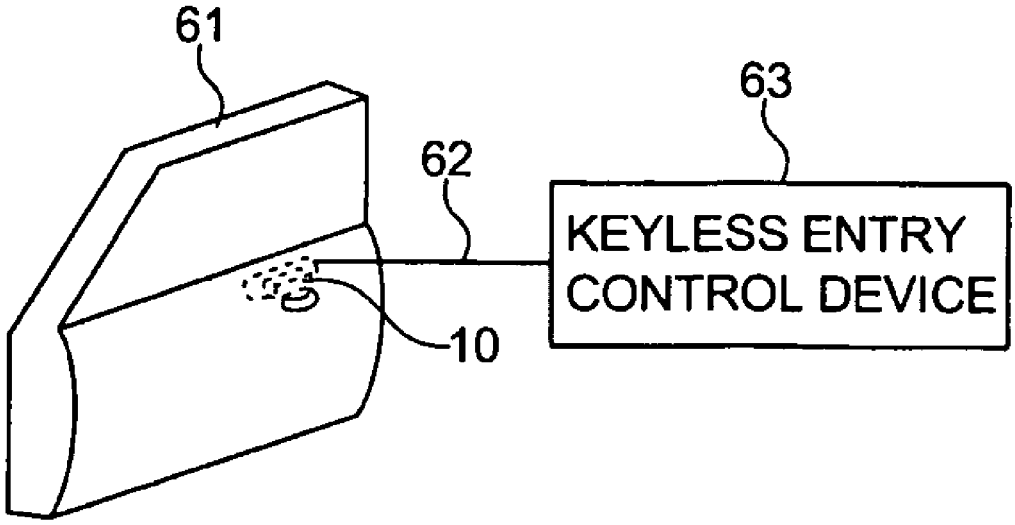
FIG. 5 is a diagram showing an example of a way the antenna device shown in FIG. 1 is used.

FIG. 5 is a diagram showing an example of the way the antenna device 10 shown in FIG. 1 is used. As shown in FIG. 5, the antenna device 10 shown in FIG. 1 is fixed, for example, to the inner side of an automotive door 61 by means of rivets or screws passed through the two through-holes 32 of the holder 6. Apart from this, the antenna device 10 may also be arranged inside a bumper, a console, etc. of an automobile. The two terminals 28 of the connector 2 are connected to a keyless entry control device 63 or the like through wiring 62 called an automotive harness.

When, for example, an AC signal is input from the keyless entry control device 63 to transmit power, a signal, etc., a radio wave based on that signal is transmitted from the antenna device 10. Further, when, for example, a radio wave from a keyless entry key (not shown) is received, the antenna device 10 outputs a signal based on that radio wave to the keyless entry control device 63. The keyless entry control device 63 has a radio circuit, and performs locking or unlocking based on the signal obtained through a radio wave.

As described above, in this embodiment, the winding 14 is electrically connected to the connector terminals 25 through the long terminals 15. Thus, it is possible to set the reactance value at a desired value by moving the bobbin 1 and, by extension, the winding 14, in the length direction of the core 3. In particular, even if the bobbin 1 (and, by extension, the winding 14) is released after being moved by hand in the length direction of the core 3 and situated at a desired position, the bobbin 1 (and, by extension, the winding 14) remains at that position. Further, even if the bobbin 1 (and, by extension, the winding 14) is moved in the length direction of the core 3, no force due to expansion and contraction of the winding 14, etc. is generated between the bobbin 1 (and, by extension, the winding 14) and the connector terminals 25. As a result, the position of the bobbin 1 (and, by extension, the winding 14) can be easily adjusted so as to attain a desired reactance value.

Further, solely by fixing the long terminals 15 and the connector terminals 25 to each other after the adjustment, it is possible to situate the winding 14 at a position where the desired reactance value can be obtained. As a result, the winding 14 undergoes no positional deviation after adjustment, making it possible to suppress variation in reactance value in the completed product.

Further, it is only necessary to fix the long terminals 15 formed of metal and the connector terminals 25 to each other, so, in contrast to the case in which the winding 14 is sealed with an insulating resin or the like, it is possible to start the next operation without having to wait until the resin is dried (until the adhesive is cured). As a result, it is possible to shorten the assembly time.

In this embodiment, the connector terminals 25 are arranged on the connector main body 21 having the through-hole 22 into which the core 3 is inserted, so the connector main body 21 can also be moved in the length direction of the core 3. Thus, the positions of the connector terminals 25 in the antenna device 10 can be easily changed without changing the basic construction of the antenna device 10. As a result, even in a case in which there is a need for antenna devices 10 of a plurality of specifications in which, for example, the requisite reactance value is the same and in which the positions of the connector terminals 25 vary, it is possible to meet the need with a single kind of antenna devices 10.

In this embodiment, the long terminals 15 are rigid members, and second through-holes are formed in the connector main body 21 to extend along the through-hole 22, with the long terminals 15 being inserted into the second through-holes. Thus, the long terminals 15 are formed as elongated terminals using a material of a higher strength than the winding 14 for the coil, and their ends are retained by the bobbin 1, the core 3, and the connector main body 21. Thus, as compared with the case in which the connection between the bobbin 1 and the connector 2 is effected by the winding 14, the antenna 10 is less likely to vibrate even if vibration is applied thereto, so a fatal problem such as an electrical breaking of wire, is not easily caused.

Further, the long terminals 15 do not slack between the bobbin 1 and the connector 2. Thus, in contrast to the conventional construction in which the wiring is slack between the winding 14 and the connector 2, there is no fear in that the reactance value may fluctuate due to shaking of the slack wiring caused by vibration or the like.

In this embodiment, the capacitor 26 is arranged on the connector main body 21, and the connector terminals 25 are connected to the capacitor 26. That is, in the antenna device 10, a resonance circuit is formed by the winding 14 as the coil and the capacitor 26. In particular, the winding 14 as the coil and the capacitor 26 are integrated, so the characteristics of the resonance circuit such as the resonance frequency can be easily adjusted to predetermined characteristics. Further, the resonance circuit is not easily influenced by the length, etc. of the wiring between the winding 14 as the coil and the capacitor 26 as in the case in which the winding 14 as the coil and the capacitor 26 are provided separately, so it is possible to suppress variation in characteristics of the resonance circuit.

In this embodiment, both ends of the winding 14 are connected to the two long terminals 15 formed of a rigid material, and the connector terminals 25 have two conductive joint portions, with one joint portion of the connector terminals 25 securing in position the long terminal 15 to which one end of the winding 14 is connected, and the other joint portion of the connector terminals 25 securing in position the long terminal 15 to which the other end of the winding 14 is connected. Thus, the winding 14 can be connected to a radio circuit through the connector terminals 25, and there is no need to provide a conductor or the like, which is subject to a breaking of wire, leading from the winding 14 and the bobbin 1 to the exterior of the antenna coil, and there is little possibility of a breaking of wire.

In this embodiment, the antenna coil, which is formed by the core 3, the bobbin 1, and the connector 2, is entirely covered with the holder 6 and the cover 7. As a result, it is possible to maintain a stable electrical characteristic for a long period of time.

In this embodiment, the cutout portions 36 are formed in the longer side surface portions 33, and the rib portions 23 are formed in the connector main body 21, with the rib portions 23 being engaged with the cutout portions 36, so it is possible to fix the connector main body 21 and the bobbin 1 connected thereto (and, by extension, the winding 14) at desired positions within the accommodating portion 35.

In this embodiment, there are provided cushion members 4, 5 which have the through-holes 52 allowing insertion of the core 3 and which are higher than the depth of the accommodating portion 35, and the engagement members 42 provided on the cover 7 are inserted into the through-holes 37 formed in the holder main body 31, thereby sealing the accommodating portion 35. In the state in which the accommodating portion 35 is sealed by the cover 7, the two cushion members 4, 5 are compressed between the cover 7 and the holder main body 31. The core 3 is held by the pressurizing force of the cushion members 4, 5, so the core 3 is secured in position inside the accommodating portion 35. Thus, the connector main body 21, the bobbin 1, the winding 14, and the core 3 can be secured in position inside the accommodating portion 35 without using fastening members such as screws, or adhesive or the like. As a result, it is possible to adjust the core 3 and the bobbin 1 to a desired positional relationship and maintain the same.

The preferred embodiment of the present invention described above should not be construed restrictively but allows various modifications and changes.

In the above-described embodiment, the winding 14 wound around the bobbin 1 and the connector terminals 25 are connected together by the long terminals 15. It is also possible, for example, to form a protrusion on the bobbin 1, and form on this protrusion a wiring serving as a substitute for the long terminals 15. Apart from this, it is also possible to extend the forward end portion of the winding 14 and to embed the extended portion in the above-mentioned protrusion.

Further, while in the above embodiment the capacitor 26 is provided on the connector 2, the capacitor 26 may be provided, if possible, on the circuit side of the keyless entry control device 63 or the like instead of being provided on the connector 2.

Further, while in the above embodiment the connector 2 and the holder 6 are separate members, it is also possible to form them as an integral unit.

INDUSTRIAL APPLICABILITY

The antenna coil and the antenna device according to the present invention can be utilized, for example, as an antenna for transmission and/or reception in a keyless entry system of an automobile, or as an antenna for transmission and/or reception of some other type of radio wave.

The invention claimed is:

1. An antenna coil comprising:

a core made of a magnetic material having a bar-like configuration;

a bobbin having a through-hole to insert the core;

a winding wound around the bobbin and whose ends are connected to a connection section;

a connector terminal being arranged on the core in order to determine a position of the winding in the length direction of the core;

the connection section being made of rigid material and extending from a fixed position on the bobbin in a length direction of the core;

the connection section having a bar-like configuration and being slidable relative to the connector terminal while retaining an electrical connection between the winding and the connector terminal.

2. An antenna coil according to claim 1, wherein:

the connector terminal is provided on a connector main body having another through-hole into which the core is to be inserted.

3. An antenna device comprising:

an antenna coil according to claim 1;

a holder having an accommodating portion formed by a holder main body and a side surface portion provided upright on the holder main body, with the accommodating portion accommodating the antenna coil; and a cover for hermetically sealing the accommodating portion.

4. An antenna coil comprising:

a core formed by shaping a magnetic material into a bar-like configuration;

a bobbin having a through-hole into which the core is to be inserted;

a connection section fixed to the bobbin so as to extend in a length direction of core from the bobbin, with the core inserted into the through-hole;

a winding which is wound around the bobbin and whose ends are connected to the connection section;

a connector terminal which is provided at a certain position in the length direction of the core, which fixes the connection section in position, and which determines a position of the winding in the length direction of the core;

the connector terminal being provided on a connector main body having another through-hole into which the core is to be inserted;

the connection section being formed of a rigid material; and a second through-hole being formed in the connector main body so as to extend along the other through-hole, the connection section being inserted into the second through-hole.

5. An antenna coil comprising:

a core formed by shaping a magnetic material into a bar-like configuration;

a bobbin having a through-hole into which the core is to be inserted;

a connection section fixed to the bobbin so as to extend in a length direction of core from the bobbin, with the core inserted into the through-hole;

a winding which is wound around the bobbin and whose ends are connected to the connection section;

a connector terminal which is provided at a certain position in the length direction of the core, which fixes the connection section in position, and which determines a position of the winding in the length direction of the core;

the connector terminal being provided on a connector main body having another through-hole into which the core is to be inserted;

a capacitor provided on the connector main body; and the connector terminal being connected to the capacitor.

6. An antenna coil comprising:

a core formed by shaping a magnetic material into a bar-like configuration;

a bobbin having a through-hole into which the core is to be inserted;

a connection section fixed to the bobbin so as to extend in a length direction of core from the bobbin, with the core inserted into the through-hole;

a winding which is wound around the bobbin and whose ends are connected to the connection section;

a connector terminal which is provided at a certain position in the length direction of the core, which fixes the connection section in position, and which determines a position of the winding in the length direction of the core;

the connection section having two conductive rigid members;

one end of the winding being connected to one rigid member of the connection section;

another end of the winding being connected to another rigid member of the connection section;

the connector terminal having two conductive joint portions;

one joint portion of the connector terminal fixes in position the rigid member of the connection section to which the one end of the winding is connected; and another joint portion of the connector terminal fixes in position the rigid member of the connection section to which the another end of the winding is connected.

7. An antenna device comprising:

a core formed by shaping a magnetic material into a bar-like configuration;

a bobbin having a through-hole into which the core is to be inserted;

a connection section fixed to the bobbin so as to extend in a length direction of core from the bobbin, with the core inserted into the through-hole;

a winding which is wound around the bobbin and whose ends are connected to the connection section;

a connector terminal which is provided at a certain position in the length direction of the core, which fixes the connection section in position, and which determines a position of the winding in the length direction of the core;

a holder having an accommodating portion formed by a holder main body and a side surface portion provided upright on the holder main body, with the accommodating portion accommodating the antenna coil;

a cover for hermetically sealing the accommodating portion;

the connector terminal of the antenna coil being provided on a connector main body having another through-hole into which the core is to be inserted; and the side surface portion and the connector main body of the antenna coil respectively having engagement portions engaged with each other and determining a position of the connector main body in a length direction of the core.

8. An antenna device according to claim 7, further comprising two cushion members having through-holes into which the core of the antenna coil is inserted and higher than a depth of the accommodating portion, wherein an engagement member provided on the cover is inserted into a through-hole formed in the holder main body, whereby the cover hermetically seals the accommodating portion.

* * * * *